United States Patent [19]

Andrew

[11] 4,133,707

[45] Jan. 9, 1979

[54] PRIMING MIX WITH MINIMUM VISCOSITY CHANGE

[75] Inventor: Eugene A. Andrew, Florissant, Mo.

[73] Assignee: Olin Corporation, New Haven, Conn.

[21] Appl. No.: 850,882

[22] Filed: Nov. 14, 1977

[51] Int. Cl.[2] ..... C06B 41/06

[52] U.S. Cl. ..... 149/28; 149/24; 149/27; 149/43; 149/44; 149/61; 149/62

[58] Field of Search ..... 149/27, 28, 44, 38, 149/25, 61, 43, 24, 62

[56] References Cited

U.S. PATENT DOCUMENTS

| | | | |
|---|---|---|---|
| 2,708,623 | 5/1955 | Franz | 149/28 |
| 3,420,137 | 1/1969 | Staba | 149/28 X |
| 3,602,283 | 8/1971 | Schlack | 149/28 |

*Primary Examiner*—Stephen J. Lechert, Jr.

*Attorney, Agent, or Firm*—William W. Jones; Paul J. Lerner

[57] ABSTRACT

An extrudable ammunition priming mix with viscosity characteristics which remain relatively stable over an extended time span. The stabilized viscosity is obtained by incorporating an effective amount of guar gum into the priming mix. The primer thus displays improved pot life so that larger batches may be made and used over an extended period of time.

6 Claims, No Drawings

PRIMING MIX WITH MINIMUM VISCOSITY CHANGE

This invention relates to an extrudable priming mix which is characterized by improved viscosity stability persisting for an extended period of time.

Extrudable priming mixes per se are known in the prior art as exemplified by the contents of U.S. Pat. No. 3,820,578, issued June 28, 1974 to Edward A. Staba, as well as other patents. One very important characteristic of a priming mix, as regards its extrudability, is its viscosity. If a mix is too viscous, it will be difficult to extrude, and if it is not sufficiently viscous, it will not extrude properly either. Not only is the viscosity per se an important characteristic of an extrudable priming mix, but the ability to provide a priming mix with a preferable viscosity which is stable over an extended time period is also desirable since this viscosity stability allows the extruder to be operated from day to day within acceptable pressure and rate parameters, and also allows the mixing of larger primer batches which can be used up over an extended period of several days with storage during periods of non-use of the extruder.

Extrudable priming mixes have included a natural gum constituent which is used to provide rheological stability needed to render the priming mixes extrudable. Specific gums which have been used are gum tragacanth, karaya gum and a treated karaya gum, as disclosed in U.S. Pat. No. 3,989,683, issued Nov. 2, 1976 to Edward A. Staba. In the latter patent, it will be noted that karaya gum treated with gluconic acid will extend the pot life or extrudability life of the extrudable primer to 96 hours, or 4 days.

I have discovered that the rheological stability of a water wet extrudable primer mix can be greatly extended by adding guar gum to the priming mix instead of karaya gum, treated karaya gum or gum tragacanth. Primer mixes incorporating an effective amount of guar gum have retained desirable viscosity, and thus extrudability, for up to fourteen days, as compared to the maximum of about four days obtainable using the prior art treated karaya gum.

The primer mixes to which this invention relates are center-fire and shotshell primer mixes which generally include one or more primary explosives, one or more fuels, an oxidizer, and, of course, an effective amount of the guar gum, along with water, which gives the primer mix a doughy consistancy rendering it extrudable. It is believed that the guar gum acts to prevent the water from existing in the primer mix as a separate water phase to any appreciable extent. It has been noted that the ability of the guar gum to prevent separation of the primer mix to a separate water phase is enhanced when the primer mix batch is stored under refrigeration at a temperature of about 45° F. during periods when it is not being extruded.

Examples of the typical constituents of extrudable primer mixes with which guar gum may be used to provide rheological stability are as follows. Primary explosives may include lead styphnate, stabanate, tetracene, and the like. Fuels may include PETN, antimony sulfide, and aluminum. Oxidizers may include such compounds as barium nitrate. These compounds are typical constituents of impact-ignited center-fire and shotshell primers and may be present in varying amounts. Additionally, the addition of guar gum to electrically initiated primer compositions containing an electrical conductor such as carbon may be effective to extend the useful life of such primers for extrudation formation.

The various primer constituents may be present in varying amounts for different primers used in different types of ammunition. For example, one type of primer used in shotshells contains 25–60% lead styphnate; 1–10% tetracene; 1–10% PETN; 20–60% barium nitrate; 5–25% antimony sulfide and 1–7% aluminum. In its extrudable form, this primer contains 15.5 to 18.5 parts per hundred (pph) of water and 0.1–1.5 parts per hundred (pph) of guar gum.

Another type of shotshell primer contains 25–60% lead styphnate; 1–10% tetracene; 0–10% PETN; 20–60% barium nitrate; 0–10% antimony sulfide; and 1–7% aluminum. In its extrudable form, this primer contains 14.5–17.5 pph water and 0.1–1.5 pph guar gum.

One type of primer used in small pistol and small rifle ammunition contains 25–60% lead styphnate; 1–10% tetracene; 1–10% PETN; 20–60% barium nitrate; 5–25% antimony sulfide; and 0–10% aluminum. In its extrudable form, this primer contains 15.5–18.5 pph water and 0.1–1.5 pph guar gum.

Another primer which is suitable for use in large pistol and large rifle ammunition contains 25–60% lead styphnate; 1–10% tetracene; 1–10% PETN; 20–60% barium nitrate; 5–25% antimony sulfide; and 1–7% aluminum. In its extrudable form, this primer contains 16.5–19.0 pph of water and 0.1–1.5 pph of guar gum. , In order to measure the viscosity of the extrudable primer mix, the following rod viscosity test is used. A two hundred gram rod of ¼ inch O.D. is positioned endwise on the top surface of a volume of the primer mix maintained in a beaker at 80° F. The rod is permitted to settle into the primer mix to a depth of three-quarters of an inch with the elapsed time needed for settling being measured. I have discovered that an elapsed time of less than about 150 seconds using this test defines a primer having an acceptable viscosity, and an elapsed time in the range of about five seconds to about ninety seconds defines a primer having a preferred viscosity. An elapsed time in the range of about eight to about fifteen defines a primer having an optimum viscosity.

A number of primer mixes were divided into three different batches, one of which included gluconic acid treated karaya gum, another of which included gluconic acid treated gum tragacanth, and the third of which included guar gum, was tested to determine viscosity with the above-described procedure except that a one-half inch penetration was measured. After four days, the karaya gum samples measured in the range of one hundred twenty seconds to achieve a one-half inch penetration, the gum tragacanth samples measured more than six hundred seconds to achieve a one-half inch penetration, and the guar gum samples measured five seconds to achieve a one-half inch penetration. Thus, the guar gum sample displayed substantially more desirable viscosity from an extrudability standpoint than either of the other two samples.

The following are specific examples of primer formulations including guar gum and observed viscosities measured by the above-described rod test using a three-quarter inch penetration.

EXAMPLE 1

To a primer containing 40% lead styphnate, 4% tetracene, 5% PETN, 30% barium nitrate, 15% antimony sulfide, and 6% aluminum, there was added 17.2 parts per hundred water and 0.6 parts per hundred guar gum. When mixed, the primer displayed a rod viscosity of nine seconds. After 3 days' storage, the primer displayed a rod viscosity of eleven seconds. After 6 days' storage, the primer displayed a rod viscosity of eight seconds; after ten days, a rod viscosity of eleven seconds; and after thirteen days, a rod viscosity of thirteen seconds. Between tests, the primer mix was stored at a temperature of about 45° F.

EXAMPLE 2

To a primer mix containing 44% lead styphnate, 4% tetracene, 51% barium nitrate, and 1% aluminum, there was added 16.3 parts per hundred water and 0.7 parts per hundred guar gum. When mixed, the primer displayed a rod viscosity of 4 seconds. After 4 days, the rod viscosity was 3 seconds; after 8 days, 3 seconds; after 15 days, 2 seconds; and after 22 days, 6 seconds. Between tests, the primer mix was stored at ambient temperature.

EXAMPLE 3

To a primer mix consisting of 40% lead styphnate, 5% tetracene, 4% PETN, 30% barium nitrate, 16% antimony sulfide, and 5% aluminum, there was added 18 parts per hundred water and 0.5 parts per hundred guar gum. When mixed, the primer displayed a rod viscosity of 2 seconds; after 3 days, 3 seconds; after 7 days, 5 seconds; after 11 days, 13 seconds; and after 14 days, 60 seconds. Between tests, the mixture was stored at a temperature of about 45° F.

EXAMPLE 4

To a primer mix consisting of 40% lead styphnate, 5% tetracene, 6% PETN, 33% barium nitrate, and 16% antimony sulfide was added 17.5 parts per hundred water and 0.5 parts per hundred guar gum. When mixed, the primer displayed a rod viscosity of 1 second; after 3 days, 7 seconds; after 6 days, 13 seconds; after 10 days, 23 seconds; and after 14 days, 8 seconds. Between tests, the mixture was stored at a temperature of about 45° F.

It will be appreciated that the priming mixes which include guar gum as a component thereof display much improved and highly desirable extended shelf life, and retain their extrudability for longer periods of time than do primer mixes including karaya gum, treated karaya gum, or gum tragacanth.

Since many changes and variations of the disclosed embodiment of the invention may be made without departing from the inventive concept, it is not intended to limit the invention otherwise than as required by the appended claims.

What is claimed is:

1. A water-bearing extrudable explosive primer mix having improved rheological stability comprising:

(a) about from 25 to 60% lead styphnate,
(b) about from 1 to 10% tetracene,
(c) about from 0 to 10% pentaerythritol tetranitrate (PETN),
(d) about from 20 to 60% barium nitrate,
(e) about from 0 to 25% antimony sulfide,
(f) about from 0 to 10% aluminum,
(g) an amount of water effective to reduce said mix to an extrudable consistancy, and
(h) an amount of guar gum effective to substantially stabilize the consistancy of said extrudable mix.

2. The primer mix of claim 1 containing about from 0.1 to 1.5 p.p.h. of guar gum.

3. The primer mix of claim 2 containing about from 1 to 10% pentaerythritol tetranitrate (PETN), about from 5 to 25% antimony sulfide, about from 1 to 7% aluminum, and about from 15.5 to 18.5 p.p.h. of water.

4. The primer mix of claim 2 containing about from 0 to 10% antimony sulfide and about from 15.5 to 18.5 p.p.h. of water.

5. The primer mix of claim 2 containing about from 1 to 10% pentaerythritol tetranitrate (PETN), about from 5 to 25% antimony sulfide, about from 1 to 7% aluminum, and about from 16.5 to 19.0 p.p.h. of water.

6. An extrudable ammunition primer mix having improved rheological stability comprising: effective amounts of at least one primary explosive, at least one oxidizer, and at least one fuel; an amount of water effective to provide said primer mix with a readily extrudable consistancy and viscosity; and an effective amount of guar gum to substantially stabilize the consistancy and viscosity of said primer mix.

* * * * *